US009599304B2

(12) United States Patent
Brendle et al.

(10) Patent No.: US 9,599,304 B2
(45) Date of Patent: Mar. 21, 2017

(54) LIGHT MODULE FOR LIGHTING EQUIPMENT OF A MOTOR VEHICLE

(71) Applicant: AUTOMOTIVE LIGHTING REUTLINGEN GMBH, Reutlingen (DE)

(72) Inventors: Matthias Brendle, Tuebingen (DE); Emil P. Stefanov, Reutlingen (DE); Armin Austerschulte, Stuttgart (DE); Hubert Zwick, Stuttgart (DE); Hermann Kellermann, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 196 days.

(21) Appl. No.: 14/230,300

(22) Filed: Mar. 31, 2014

(65) Prior Publication Data

US 2014/0307459 A1 Oct. 16, 2014

(30) Foreign Application Priority Data

Apr. 11, 2013 (DE) ..... 10 2013 206 488

(51) Int. Cl.
*F21V 1/00* (2006.01)
*F21V 33/00* (2006.01)
*F21S 8/10* (2006.01)

(52) U.S. Cl.
CPC ..... *F21S 48/1721* (2013.01); *F21S 48/1154* (2013.01); *F21S 48/1159* (2013.01);
(Continued)

(58) Field of Classification Search
CPC ..... F21S 48/1154; F21S 48/1159; F21S 48/1241; F21S 48/1266; F21S 48/137;
(Continued)

(56) References Cited

U.S. PATENT DOCUMENTS 6,758,582 B1 7/2004 Hsiao et al.
7,055,991 B2 6/2006 Lin
(Continued)

FOREIGN PATENT DOCUMENTS

AT 511 760 A1 2/2013
DE 102004008296 A1 9/2005
(Continued)

OTHER PUBLICATIONS

Jan. 15, 2014 Search Report for DE 10 2013 206 488.8.
(Continued)

*Primary Examiner* — Peggy Neils
*Assistant Examiner* — Tsion Tumebo
(74) *Attorney, Agent, or Firm* — Howard & Howard Attorneys PLLC

(57) ABSTRACT

A light module of a lighting equipment of a motor vehicle that includes several separately controllable light sources combined in an array, several primary optics elements in the form of collective lenses, each of which has a light ingress surface and a light emitting surface, that are combined to a primary optics array, wherein the primary optics elements concentrate at least a portion of the light emitted by the light sources and generate intermediate light distributions on the light emitting surfaces, and a secondary optics system for reproducing the emitted light on a road in front of a motor vehicle as resulting total light distribution of the light module. The secondary optics system for reproducing the intermediate light distributions as resulting total light distribution of the light module is focused on at least one of the light-emitting surfaces of the collective lenses.

5 Claims, 11 Drawing Sheets

(52) U.S. Cl.
CPC ..... *F21S 48/1241* (2013.01); *F21S 48/1266* (2013.01); *F21S 48/137* (2013.01); *F21S 48/1323* (2013.01); *F21S 48/1329* (2013.01); *F21S 48/1388* (2013.01); *F21S 48/1747* (2013.01); *F21S 48/328* (2013.01)

(58) Field of Classification Search
CPC ..... F21S 48/1388; F21S 48/1721; F21S 48/1747; F21S 48/328
USPC ..... 362/509, 520, 538, 543, 544, 521, 514, 362/516–518
See application file for complete search history.

(56) References Cited

U.S. PATENT DOCUMENTS

| | | | | |
|---|---|---|---|---|
| 2005/0052751 | A1 | 3/2005 | Liu et al. | |
| 2008/0062706 | A1* | 3/2008 | Feldmeier | B60Q 1/1423 362/459 |
| 2008/0080201 | A1* | 4/2008 | Specht | F21S 48/1154 362/507 |
| 2009/0284980 | A1* | 11/2009 | Iwasaki | F21S 48/1159 362/517 |
| 2010/0260945 | A1* | 10/2010 | Kites | B05D 3/061 427/553 |
| 2011/0080728 | A1* | 4/2011 | Nakagawa | F21V 5/04 362/235 |
| 2013/0051014 | A1 | 2/2013 | Sikkens et al. | |
| 2014/0175978 | A1* | 6/2014 | Kobayashi | B60Q 1/1423 315/82 |
| 2014/0204602 | A1* | 7/2014 | Jungwirth | F21S 48/1154 362/521 |

FOREIGN PATENT DOCUMENTS

| | | | |
|---|---|---|---|
| DE | 102007052696 | A1 | 7/2008 |
| DE | 10 2007 052 742 | A1 | 5/2009 |
| DE | 10 2008 005 488 | A1 | 7/2009 |
| DE | 10 2009 053 581 | B3 | 3/2011 |
| DE | 10 2010 023 360 | A1 | 4/2011 |
| DE | 10 2010 029 176 | A1 | 12/2012 |
| DE | 10 2012 202 290 | A1 | 8/2013 |
| EP | 2 045 515 | A1 | 4/2009 |
| EP | 2159481 | A1 | 3/2010 |
| EP | 2 357 399 | A1 | 8/2011 |
| EP | 2 388 512 | A2 | 11/2011 |
| JP | 2011171002 | A | 9/2011 |

OTHER PUBLICATIONS

Communication mailed Aug. 3, 2016 from the European Patent Office enclosing the European Search Report dated Jul. 25, 2016 for European Patent Application No. 14160764.8.

* cited by examiner

LIGHT MODULE FOR LIGHTING EQUIPMENT OF A MOTOR VEHICLE

CROSS-REFERENCE TO RELATED APPLICATION

This application is based upon and claims priority to German Patent Application DE 10 2013 206 488.8 filed on Apr. 11, 2013.

BACKGROUND OF THE INVENTION

1. Field of the Invention

The present invention relates generally to a light module of a lighting equipment of a motor vehicle and, more specifically, to lighting equipment having one or several light modules.

2. Description of Related Art

Various approaches are known in the art for implementing glare-free high beam without the use of variable speed motors by utilizing special light modules designed as projection systems. To this end, intermediate images are generated from several semiconductor light sources (for example, LEDs) with a primary optics array. Using a lens system, the intermediate images are projected on the road in front of the vehicle so as to generate the resulting light distribution of the light module. For example, such a light module is known from DE 2008 013 603 A1.

Currently, projection modules generate light-dark boundaries as well as dark-light boundaries. Specifically, it is not specified which side of the road should be illuminated. As such, single-lens projection systems can be used only to a limited extent because of their color aberrations. For example, to solve this problem, DE 10 2010 029 176 A1 proposes using achromatic, two-lens systems.

In lens systems, the problem of a chromatic aberration can be avoided by using a reflector as secondary or projection optics. Unlike lens systems, reflector systems have no aberrations, can be produced in a simple and cost-effective manner (especially when large optical areas are required), and do not cause any stray light through Fresnel reflections. However, reflector systems have the disadvantage of developing aperture distortions in larger numeric apertures (for example, different reflector zones have different extensions). Furthermore, in reflector systems, off-axis rays result in a displacement (referred to in the art as "coma"). As a result, a square light source is not represented as a square but rather in the deformed shape of a trapeze or mushroom, wherein size, position and orientation of the image largely depend on the position of the light source in the object field. However, a system generating from multiple semiconductor light sources and having several straight, strictly limited light distributions with definite positions of the individual light-dark boundaries inherently includes imaging properties. Thus, an appropriate total light distribution of a light module needs to be constructed or composed of light source images of the same size and orientation.

In addition, matrix high beam modules known in the art usually use single-chip LEDs, especially SMD (surface mounted device) LEDs in conjunction with a primary optics array. The primary optics array generates intermediate images on the light emitting surfaces of the primary optics elements of the optics array, which are then projected on the road by the secondary optics located downstream in the beam path. Due to the distances between the LEDs, the areas of the intermediate images (referred to in the art as "pixels") are large, which necessitates using projection lenses with great focal width. Consequently, the resulting light modules are relatively large, which is disadvantageous in motor vehicles because of the relatively limited installation space available for the light modules or the lighting equipment provided with these light modules.

With regard to prior art, in addition to the two above-mentioned publications, reference is also made to the following publications: DE 10 2008 005 488 A1, DE 10 2007 052 742 A1, DE 10 2009 053 581 B3, DE 10 2010 023 360 A1, EP 2 045 515 A1, EP 2 388 512 A2, U.S. Pat. No. 6,758,582 B1 and U.S. Pat. No. 7,055,991 B2.

SUMMARY OF THE INVENTION

It is the object of the present invention to provide a light module for generating a resulting total light distribution from the light of matrix-like light sources in such a way that an especially homogenous total light distribution is achieved while, at the same time, providing light module having a compact size and short length. Moreover, by switching (selectively switching on and off) the different light modules, it is possible to switch between the different adjacent intermediate light distributions on the light emitting surfaces of the primary optics elements in order to obtain a glare-free high beam as resulting total light distribution. In operation, the projections of one or several intermediate light distributions are selectively removed from the areas of the total light distribution where other road users are located.

The present invention is directed toward a light module of a lighting equipment of a motor vehicle including a light source assembly with multiple separately controllable light sources combined to an array for emitting light, multiple primary optics elements combined to a primary optics array in the form of collective lenses each of which has a light ingress surface, and a light-emitting surface wherein the primary optics elements are designed to concentrate at least a portion of the light emitted by the light sources and to generate intermediate light distributions on the light emitting surfaces. Further, the invention includes secondary optics system for reproducing the emitted light on a road in front of the motor vehicle as resulting total light distribution of the light module, wherein the secondary optics system for reproducing the intermediate light distributions on the road in front of the motor vehicle as resulting total light distribution of the light module is focused at least on one of the light-emitting surfaces of the collective lenses.

The light module includes several primary optics elements combined to the primary optics array, in which each primary optics element has a light ingress surface and a light emitting surface. The primary optics elements are designed for concentrating at least a portion of the light emitted by the light sources and for generating intermediate light distributions on the light emitting surfaces of the primary optics elements. The secondary optics system is focused on the reproduction of the intermediate light distributions on the road in front of the motor vehicle as resulting total light distribution of the light module on at least one of the light emitting surfaces. It is possible that the secondary optics has not only one focal point but multiple focal points, wherein several of the focal points can be focused on several of the light emitting surfaces. Therefore, it is required (and in practice, difficult to implement) that the focal point or focal points of the secondary optics are focused on the light emitting surfaces of all primary optics elements.

Consequently, the light module includes a semiconductor light source array, as well as a primary optics array, wherein the intermediate light distributions generated on the light-emitting surfaces of the optics array are projected on the road by the secondary optics system. Therefore, not reproductions of the light sources but only illuminated areas are projected on the road. Subsequently, the combination of light source array and primary optics array is also depicted as substitute light source array. A light source and the attached primary optics array is also depicted as substitute light source, wherein several substitute light sources can be arranged to an array directly next to each other or above each other. At the same time, the primary optics elements arranged next to each other in one or several lines form the primary optics array. Usually the primary optics elements are larger than the light sources respectively attached to the primary optics elements, resulting in relatively large distances between the individual light sources of a substitute light source array.

Compared with conventional projection systems, in the invention-based light module, the collective lenses in the Petzval surface of the object-side secondary optics do not generate reproductions of the light sources. In the invention-based light module, only the light-emitting surfaces of the collective lenses are illuminated. The secondary optics is focused on one or several of these illuminated areas. On the light-emitting surfaces, the collective lens array includes a plane luminance without maxima. Specifically, this applies to the light distribution in the sections extending vertically to the light-dark boundaries or pixel limits. As such, the secondary optics focuses on the exit pupil of the primary optics array.

Advantageously, compared with conventional projection systems, in an invention-based light module the formation of the light distribution (for example, the vertical and/or horizontal course of the pixels) is performed at least partially by the secondary optics in order to implement the total light distribution. In one embodiment, the formation of the light distribution is performed completely or almost completely by the secondary optics. In particular, this is possible with a primary optics array in the form of a collective lens array because here no important luminance differences can be generated in the exit pupil of the primary optics. At the same time, light shaping can be performed almost completely by, for example, toric secondary optics.

Advantageously, the light sources are designed in the form of semiconductor light sources, especially in the form of LED light sources, LED arrays, single chip LEDs or SMD LEDs.

In various embodiments of the invention, the secondary optics can be designed: in the form of a parabolic reflector, especially a faceted parabolic reflector; in the form of a collective lens, especially an aplanatic collective lens; in the form of an achromatic system with a combination of a collective lens having minor color dispersion and a dispersing lens having major color dispersion; in the form of a combination of a hyperbolic reflector and a collective lens, wherein an object-side focal point of the collective lens coincides with an image-side focal point of the hyperbolic reflector; or in the form of a combination of an elliptic reflector and a dispersing lens, wherein an object-side focal point of the dispersing lens coincides with an image-side focal point of the ellipsoid reflector.

Further, the primary optics array can be designed: in the form of a collective lens array, especially an array having plano-convex lenses, advantageous is a lens array with toric lens surfaces; in the form of a reflector array, especially with polygonal cross-sectional areas, particularly with square, rectangular, or triangular reflector cross-section, where thee reflector areas may be designed as plane minor surfaces or cylindrical hyperboloid surfaces; in the form of a light conductor array, wherein the individual light conductors may be designed as conical light conductors with a cross-sectional area that is increasing from its light ingress surface toward its light-emitting surface wherein the light conductors may have a polygonal cross-section (such as triangular, rectangular, or square), with a light ingress surface of a light conductor designed as a plane surface and arranged orthogonal to the primary beam direction of the attached semiconductor light source, in particular parallel to the surface extension of a semiconductor chip, where a light-emitting surface of a light conductor may have a convex curvature; in the form of a light conductor array with multiple disc-shaped light conductors wherein each of the light conductor discs includes a light ingress surface, a light-emitting surface, a reflector area and two transport areas on which light coupled into the light conductor is transported via total reflection to the light-emitting surface, where the reflector area may be located between the light ingress and light-emitting surfaces, where the light ingress and light-emitting surfaces may form together with the reflector area two focal lines which are subject to the figure law such that the optical paths between the object-side and the image-side focal line have the same optical path lengths: the sumi (si×ni)=constant.

When using two-piece or multi-piece optics, the image-side focal point which prepends the primary optics in beam direction coincides with the object-side focal point of the subsequent secondary optics. Both optics have equal optical axes (rotation axes of lenses and reflectors). A secondary optics with multiple reflectors or mirrors connected in series makes it possible to fold the beam path, thus considerably reducing the structural length of the light module.

In one embodiment, the focal point of the secondary optics is situated on a light-emitting surface of the substitute light source array and reproduces it on the road. In order to achieve high imaging quality, the secondary optics is designed in such a way that all optical paths between the focal point and the (infinitely distant) pixel have the same length. For example, when using reflectors as primary optics and/or secondary optics (paraboloid, hyperboloid or ellipsoid reflectors), this is achieved as discussed below.

The light source or substitute light source array may radiate at an acute angle into the reflector against driving direction of the motor vehicle or in transversal direction (for example, the beam path is folded by the reflector at an acute angle). Furthermore, the reflector may be facetted in such a way that all faceted surfaces have almost the same distances to a mutual focal point of the reflector. All facet edges facing away from the optical axis (rotation axis) of the light module have larger distances to the mutual focal point of the reflector than the internal facet edges located on the side of the optical axis. Further, the facet edges may extend in vertical direction to the light-dark boundaries of the resulting total light distribution (for example, vertical light-dark boundary at the strip beam→horizontal facet edges). It is also advantageous to use annular reflector facets arranged concentrically about the optical axis.

The subsequent list provides different combinations of light sources, primary optics and secondary optics. All combinations included in the subject matter of the present invention are marked with an X. Those combinations which represent an interesting solution from a technical viewpoint or from the aspect of being achievable are marked with X':

| Light source or substitute light source Secondary optics | LED array without optical head | LEDs with lens array | LEDs with reflector array | LEDs with light conductor array | LEDs with light conductor discs |
|---|---|---|---|---|---|
| Projection lens | | X | | | X' |
| Achromatic system (two-lens system) | | X | | | X' |
| Parabolic reflector | | X | X' | X' | X' |
| Ellipsoid and dispersing lens | X' | X | X' | X' | X' |
| Hyperboloid/plane mirror and collective lens | X' | X | X' | X' | X' |
| Hyperboloid/plane mirror and paraboloid | X' | X | X' | X' | X' |

BRIEF DESCRIPTION OF THE DRAWINGS

Further characteristics and advantages of the present invention are included in the following description with reference to the figures. At the same time, the invention-based light module can have the characteristics and advantages mentioned with regard to the different embodiments also on an individual basis or in any combination different from the combinations described in the embodiments, wherein.

DETAILED DESCRIPTION OF THE INVENTION

Figure 1:
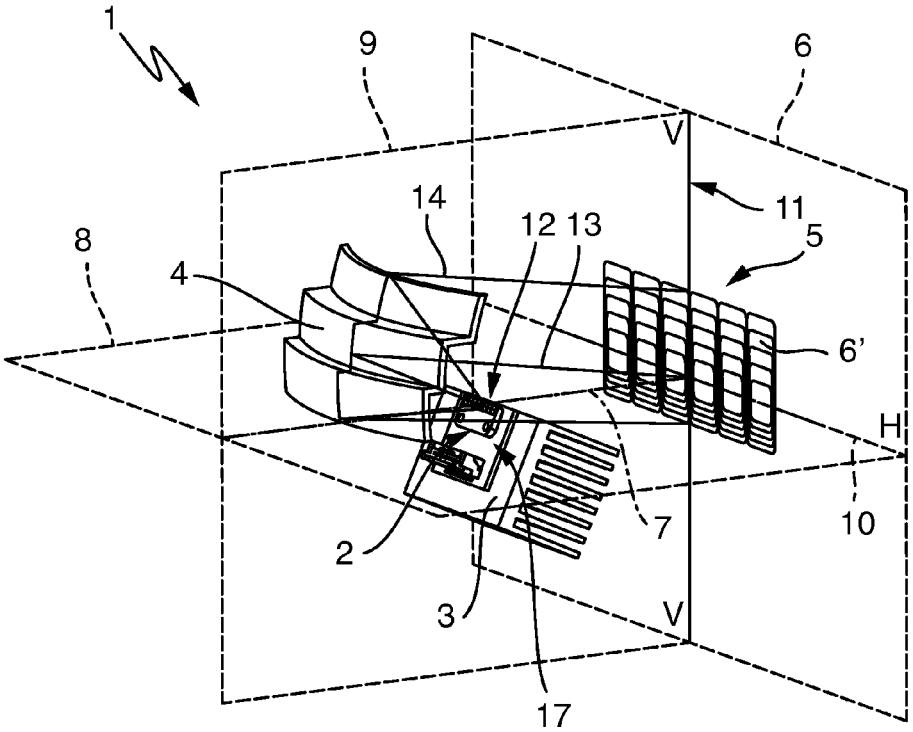
FIG. 1 shows an invention-based light module of one embodiment.

The present invention relates to a light module which is depicted in its entirety in the figures and which has the reference numeral 1. The light module 1 is intended to be installed in lighting equipment of a motor vehicle. The lighting equipment may be designed as a motor vehicle headlamp. However, it can be designed also as a motor vehicle lamp. Typically, the lighting equipment includes a housing with a light emitting aperture which is closed by a transparent cover panel. The light module 1 can be arranged in the housing in rigid or flexible manner. By moving the light module 1 relative to the housing, it is possible to provide headlamp range adjustment and/or adaptive headlight function. It is possible to install in the housing multiple invention-based light modules 1. However, it is also possible to install in the housing the invention-based light module 1 in conjunction with light modules that are not based on the present invention.

The invention-based light module 1 includes a light source array 15 (see FIG. 2) having at least two light sources 16, which may be designed in the form of semiconductor light sources, and mutual secondary optics 4. In addition, the light module 1 may include a primary optics array 17 with multiple primary optics elements 18 which concentrate the light emitted from the light sources 16. In this case, the light source array is described also as substitute light source array 2. On the light-emitting surfaces 25 (see FIG. 3) of the primary optics elements 18, intermediate light distributions are generated, which reproduce the secondary optics 4 on the road in front of the motor vehicle for generating a resulting total light distribution 5 of the light module 1.

In one embodiment, the secondary optics 4 focuses on the light-emitting surfaces 25 of the substitute light source array 2 or the primary optics elements 18. In the light module 1, the intermediate light distributions generated by the light sources on the light-emitting surfaces 25 of the primary optics array 17 may be combined in such a way that the individual light distributions 6' are at least partially superimposed or added and thus form the resulting total light distribution 5 of the light module 1. For example, the total light distribution 5 is a so-called glare-free high beam. In the invention-based light module 1, the secondary optics 4 reproduces on the road only the intermediate light distributions on the light-emitting surfaces 25 of the primary optic elements 18 (for example, the illuminated surfaces 25) and not the images of the light sources 16. In this way, the secondary optics 4 is not focused on images of the light sources 16 but on the light-emitting surfaces 25 of the primary optics elements 18.

Figure 15:
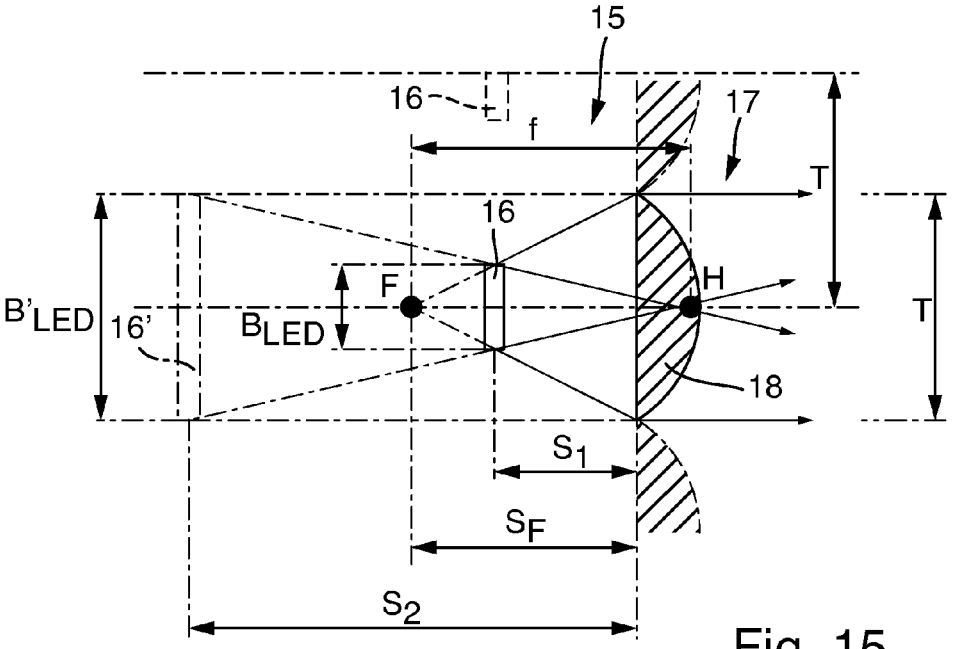
FIG. 15 shows a sectional view of a substitute light source array for use in a light module of the present invention.

FIG. 15 shows a sectional view of a substitute light source array 2 for use in an invention-based light module 1. In an exemplary manner, one of several semiconductor light sources 16 is depicted in the form of an LED chip. In an exemplary manner, one of several collective lenses 18 of the collective lens array 17 is depicted in light-emitting direction after the LED chip 16. A division of the lens array 17 is depicted with T. The division T corresponds to the width of the individual collective lenses 18, as well as the distance of the centers of adjacent LED chips 16. BLED depicts an edge length of the LED chip 16. A virtual LED chip is depicted with 16'. The edge length of the virtual LED chip 16' is depicted with B'LED. An object-side focal point of the collective lens 18 is depicted with F and a major focus of the lens 18 is depicted with H. The major focus H of a lens is defined as intersection point of a principal plane of the lens with the optical axis. The secondary optics 4 of the invention-based light module may be focused on a major focus H of one of the collective lenses 18, specifically the major focus H of the collective lens located near an optical axis 7 of the light module 1. The reference numeral f depicts the focal width of the lens 18 and SF depicts a back focal distance of the lens 18. A distance between the LED chip 16 and the light ingress surface of the collective lens 18 is depicted with S1, and a distance between the virtual chip image 16' and the light ingress surface of the lens is depicted with S2.

The LED chip 16 is located between the lens 18 and its object-side focal point F. The LED chip 16 is enlarged by the lens 18 in such a way that the (upright) virtual image 16' of the chip (in light-emitting direction in front of the object-side focus of the lens F) has almost the same size as the lens 18 (for example, B'LED~T). The following combinations apply to the indicated approximate sizes:

$$\frac{SF - S1}{SF} \sim \frac{BLED}{T} \sim \frac{BLED}{BLED}$$

$$0.1\ \text{mm} \leq S_1 \leq 2\ \text{mm}$$

$$1 \times B_{LED} \leq T \leq 4 \times B_{LED}$$

The collective lenses 18 of the lens array 17 do not have the purpose of generating real intermediate images of the light sources 16, but form only an illuminated surface on the light-emitting side 25 of the collective lenses 18. The light sources 16 are arranged between the light ingress surfaces of lenses 18 and the object-side focal points F of the lenses 18 in such a way that the edges of the light sources 16 are located on geometric connections between the focal points F and the lens edges. The light-emitting surfaces of the light sources 16 are arranged perpendicularly to the optical axes of the lenses 18. This results in a very even illumination of the lenses 18 and an especially homogeneous light distribution, the so-called intermediate light distribution, on the light emitting surfaces 25 of the lenses 18. With the secondary optics array 4, the intermediate light distributions are reproduced on the road in front of the vehicle for generating the resulting total light distribution of the light module 1. The optical axes of the individual lenses 18 of the array all run in one plane, and advantageously run parallel to each other. On the side facing the primary optics 17, the axis of the secondary optics 4 runs parallel to the axis of at least one of the lenses 18.

FIG. 1 shows one embodiment of an invention-based light module 1. The light module 1 includes multiple separately controllable semiconductor light sources 16 (see FIG. 2) for emitting light that are combined in an array. As shown, several LEDs 16 are arranged next to each other in a row. However, it is also possible to arrange the LEDs 16 in several rows on top of each other in matrix-like manner. Each of the semiconductor light sources 16 represents a primary optics element 18 (see FIG. 3) for concentrating at least a portion of the light-emitted by the light source 16 and for generating an intermediate light distribution on the light-emitting surface 25. The primary optics elements 18 are combined into a primary optics array 17. The primary optics elements 18 may be designed in the form of collective lenses which are combined to a collective lens array. The primary optics array 17 or the individual primary optics elements 18 can also be depicted as optical head. The intermediate light distributions are generated on light-emitting surfaces of the primary optics elements 18. The intermediate light distributions are reproduced on the road in front of the motor vehicle by the secondary optics system 4 in the form of individual light distributions 6' for generating the resulting total light distribution 5 of the light module 1. As discussed above, the combination of semiconductor light source array 15 and primary optics array 17 is subsequently depicted as substitute light source array 2. For thermal stabilization, in particular for dissipating waste heat resulting from operating the semiconductor light sources, the semiconductor light sources 16 are arranged directly or indirectly on a cooling element 3 above the conductor board 19 or a similar object.

In the example shown, the secondary optics system 4 is designed in the form of a horizontally facetted reflector, especially a parabolic reflector. Thus, in a vertical section the reflector 4 includes several facets arranged on top of each other. The secondary optics system 4 focuses on the light-emitting surfaces 25 of the primary optics elements 18 or the substitute light source array 2. A resulting total light distribution 5 of the light module 1 is represented in an exemplary manner on a measuring screen 6 which is arranged in a definite distance to the light module 1. The total light distribution 5 includes a plurality of individual light distributions 6' which are generated by the individual elements 16, 18 of the substitute light source array 2 in interaction with the secondary optics system 4.

Furthermore, FIG. 1 shows an optical axis 7 of the light module 1. A sagittal plane 8 has a basically horizontal surface extension and includes the optical axis 7. A meridian plane 9 has a basically vertical extension and includes also the optical axis 7. An intersecting line between the sagittal plane 8 and the measuring screen 6 forms a horizontal line HH 10, and an intersecting line between the meridian plane 9 and the measuring screen 6 forms a vertical line VV 11. The optical axis 7 extends through the intersection point HV of the horizontal line 10 and the vertical line 11. Thus, the resulting total light distribution 5 extends underneath the horizontal line 10, as well as above the horizontal line 10. For example, the total light distribution 5 can involve a so-called matrix high beam or a so-called strip beam or a portion of them. However, the total light distribution 5 can also form an especially brightly illuminated central area of the high beam (high beam spot).

In FIG. 1, a focal point of the facetted parabolic reflector 4 is depicted with the reference numeral 12. The focal point 12 is located on a light-emitting surface 25 of the substitute light source array 2 or on a light-emitting surface 25 of the primary optics array 17, especially on a central area of the substitute light source array 2. The optical path of a main beam is depicted with the reference numeral 13 and the optical path or a side beam with the reference numeral 14. The main beam 13 results from a light beam that is emitted basically in primary beam direction 29 (see FIG. 8) by one of the light sources 16 being shaped and possibly deflected by a primary optics element 18 attached to the light source 16, as well as being deflected at the secondary optics system 4. Correspondingly, the side beam 14 results from a light beam 29' that is emitted transversally to the primary beam direction 29.

Figure 2:
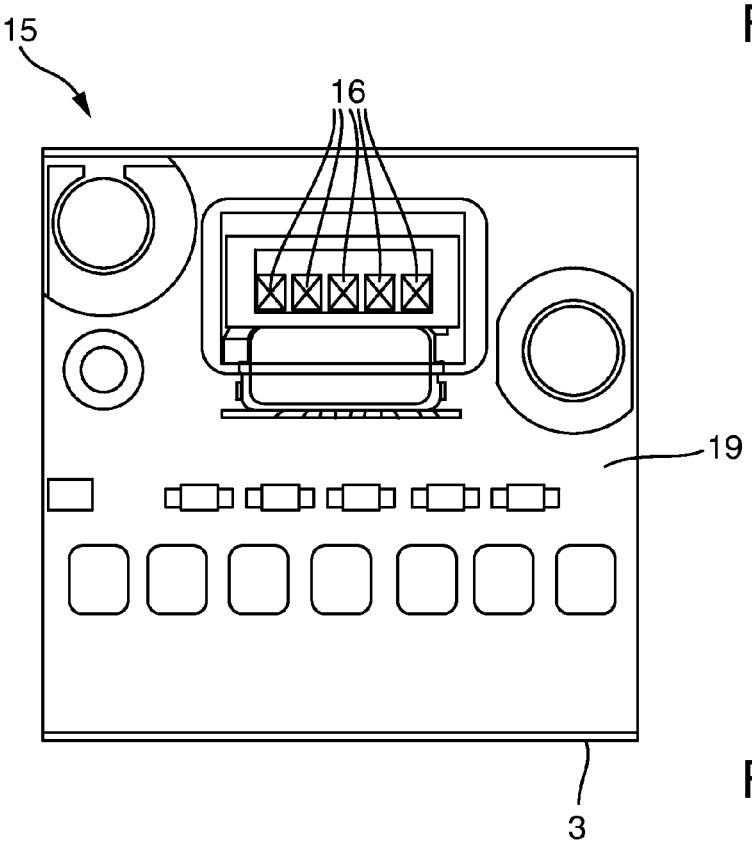
FIG. 2 shows light sources for use in an invention-based light module of one embodiment.

FIG. 2 shows an enlarged view of a light source array 15 of the invention-based light module 1 which includes multiple LED chips 16 (five in the embodiment shown) arranged in a straight line next to each other. It is certainly also possible to arrange the individual light sources 16 in a different way than the one shown in FIG. 2, for example, in matrix-like manner in several rows and columns. Moreover, the light source array 15 may includes a different number of individual light sources 16 than in FIG. 2. Furthermore, it is possible to arrange the light sources 16 in a curvature or any other manner instead of in a straight line.

Figure 3:
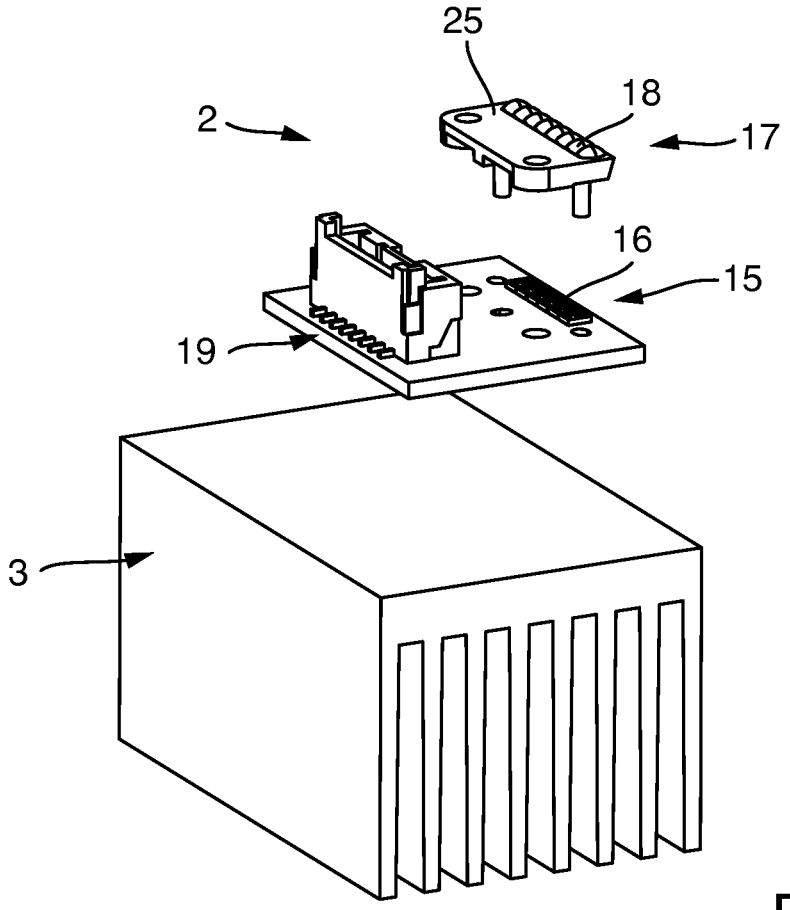
FIG. 3 shows substitute light sources for use in an invention-based light module of one embodiment.
Figure 4A:
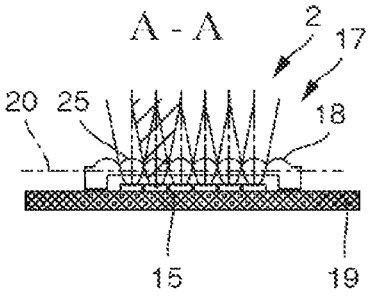
FIG. 4A shows a first sectional view of the substitute light source of FIG. 3 along line A-A of FIG. 4C.
Figure 4B:
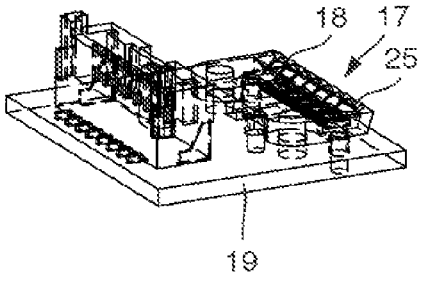
FIG. 4B shows the substitute light source of FIG. 3 in a perspective view in part with transparent components for a better view of the overall light source.
Figure 4C:
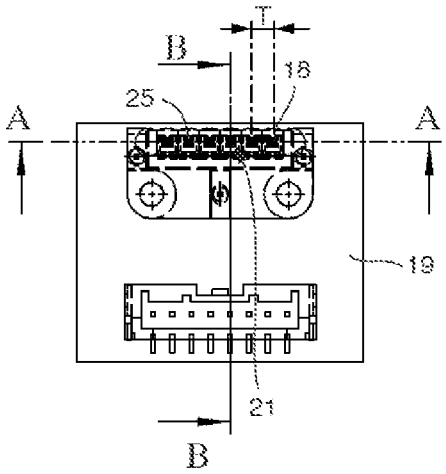
FIG. 4C shows a top view of the substitute light source of FIG. 3.
Figure 4D:
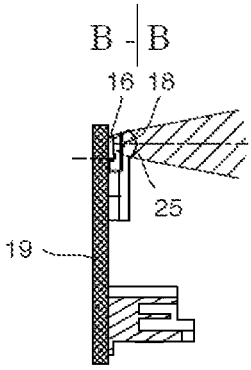
FIG. 4D shows a second sectional view of the substitute light source of FIG. 3 along line B-B of FIG. 4C.
Figure 5A:
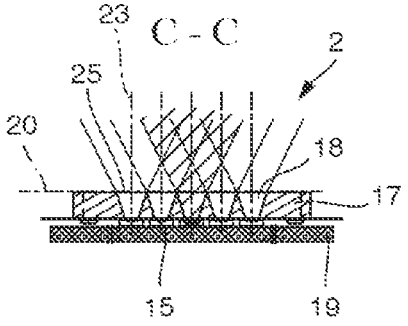
FIG. 5A shows a first sectional view of an alternative substitute light source along line C-C of FIG. 5C.
Figure 5B:
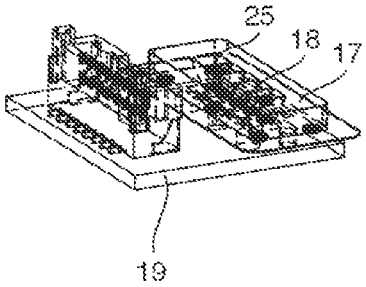
FIG. 5B shows the substitute light source of FIG. 5A in a perspective view in part with transparent components for a better view of the overall light source.
Figure 5C:
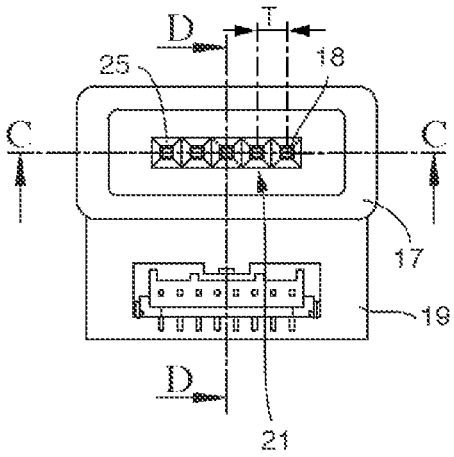
FIG. 5C shows a top view of the substitute light source of FIG. 5A.
Figure 5D:
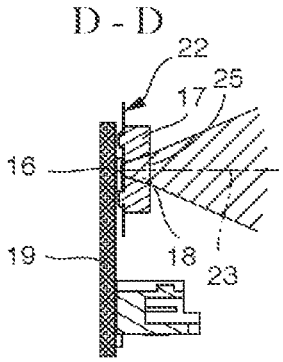
FIG. 5D shows a second sectional view of the substitute light source of FIG. 5A along line D-D of FIG. 5C.
Figure 6A:
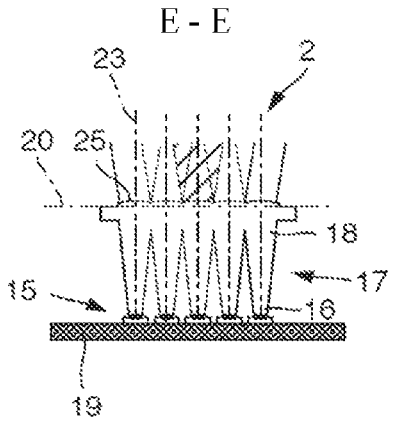
FIG. 6A shows a first sectional view of an alternative substitute light source along line E-E of FIG. 6C.
Figure 6B:
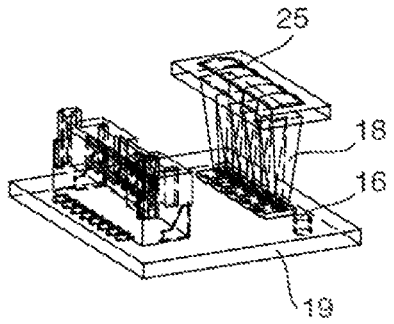
FIG. 6B shows the substitute light source of FIG. 6A in a perspective view in part with transparent components for a better view of the overall light source.
Figure 6C:
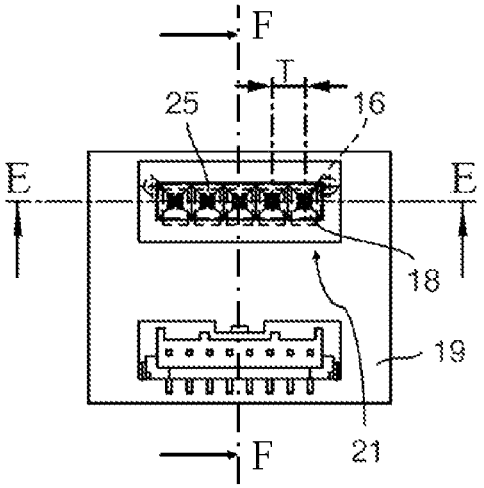
FIG. 6C shows a top view of the substitute light source of FIG. 6A.
Figure 6D:
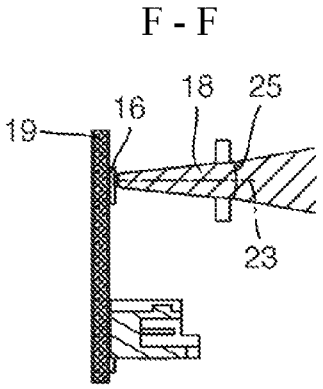
FIG. 6D shows a second sectional view of the substitute light source of FIG. 6A along line F-F of FIG. 6C.
Figure 7A:
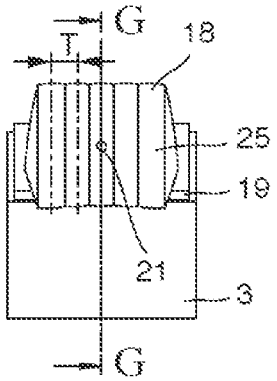
FIG. 7A shows a front view of an alternative substitute light source.
Figure 7B:
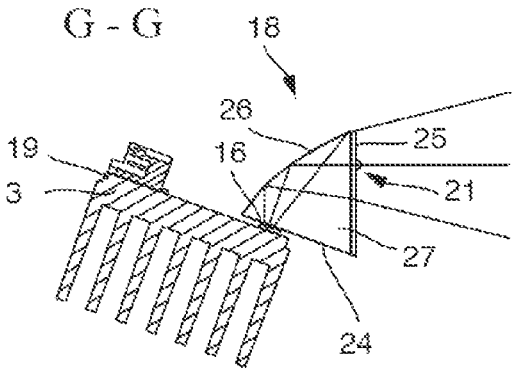
FIG. 7B shows the substitute light source of FIG. 7A in a sectional view along line G-G.
Figure 7C:
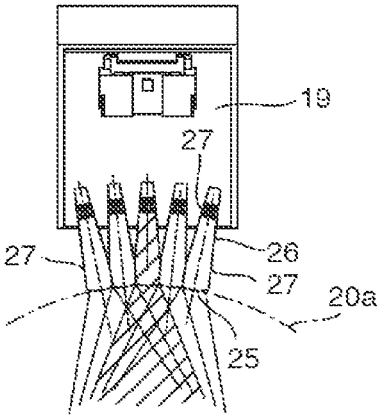
FIG. 7C shows a top view of the substitute light source of FIG. 7A.
Figure 7D:
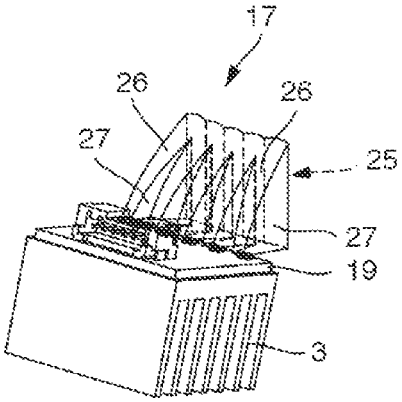
FIG. 7D shows a perspective view of the substitute light source of FIG. 7A.

In the embodiment shown in FIG. 3, the light source arrangement includes a light source array 15 and a primary optics array 17. The light source array 15 includes several SMD (surface mounted device) LEDs which, in the example shown, are arranged directly next to each other on a straight line. The primary optics array 17 includes several (five in the example shown) collective lenses 18 arranged next to each other. The LEDs of the light source array 15 are arranged and connected on a mutual plane, advantageously on a mutual conductor board. The combination of the light source array 15 and the primary optics array 17 forms the substitute light source array 2. Each primary optics element 18 is attached to at least one light source 16. Each primary optics element 18 may be attached to one semiconductor light source 16. Consequently, arranging the collective lenses 18 in the collective lens array 17 corresponds to arranging the light sources 16 in the light source array 15. The light-emitting surfaces 25 of the primary optics elements 18 may directly adjoin each other. In the embodiment shown in FIG. 3, the primary optics elements 18 are larger than the LED chips or SMD-LEDs attached to them. Therefore, there are distances between the individual semiconductor light sources 16 in the substitute light source array 2.

FIGS. 4A-4D show different views of the substitute light source array 2 shown in FIG. 3. At the same time, the individual primary optics elements 18 are designed in the form of plano-convex collective lenses. In this case, the primary optics array 17 involves a lens array that may be constructed of plano-convex lenses. The lens array 17 may include organic or inorganic glass or of silicone rubber (LSR, liquid silicone rubber). For example, organic glasses include polymethyl methacrylate (PMMA), cyclo-olefin copolymer (COC), cyclo-olefin polymer (COP), polycarbonate (PC), polysulfone (PSU) or polymethacryl methylimide (PMMI). In the example shown, a total of six LEDs 16 are attached to six primary optics elements 18. Although the primary optics 17 shown includes eight primary optics elements 18, the two outer primary optics elements 18 are not attached to any LED 16.

Furthermore, FIGS. 4A-4D depict a focal plane of the secondary optics with the reference numeral 20. A focal point of the secondary optics 4 is depicted with the reference numeral 21. A division between two adjacent individual light sources 16 or between two adjacent primary optics elements 18 is depicted with T. At the same time, the division T is indicated to extend from the central point of a light source 16 or a primary optics element 18 to the central point of the adjacent light source 16 or the adjacent primary optics element 18.

FIGS. 5A-5D show different views of a different exemplary substitute light source array 2 for use in a light module 1. At the same time, the primary optics elements 18 are designed as reflectors. In the example shown, said reflectors have a square cross-section. The light-emitting surfaces 25 of the individual reflectors 18 are lined up without gaps in between and restrict the illuminated surface with sharp straight edges. Each light source 16 (including at least one LED) may be attached to one reflector element 18. If desired, a (perforated) thermal-insulation plate 22 can be provided between reflector array 17 and the light source array 15, protecting the rear side of the reflector array 17 against irradiation. The thermal-insulation plate 22 prevents thermal overload of the reflector material.

The reflectors 18 expand in conical fashion from light entry to light exit 25. Vertically to an optical axis 23 or to the primary beam direction 29 of the light sources 16 (see FIG. 8A), the reflectors 18 may include triangular, square, or rectangular cross-sections. It is especially advantageous that the reflectors 18 have the geometric form of a truncated pyramid. The reflection surface of the reflectors 18 may include cylindrical hyperboloids or plane minors as special case of the hyperboloid. The reflector array 17 includes a metalized, high-temperature proof plastic material, especially a thermoplastic material. Highly suitable high-temperature proof thermoplastics involve, for example, polyetheretherketone, polyetherimide or polysulfone. Metallization includes, for example, of aluminum, silver, platinum, gold, nickel, chrome, copper, tin, or alloys containing at least one of these metals. After applying to the reflection surface, the metallization may be sealed with a transparent layer. Instead of metallization, it is also possible to apply a multi-layer coating on the plastic body. In the process of multi-layer coating, several low and high refractive layers are combined in alternating manner. Underneath the reflecting metal or multi-layer coating, it is possible to provide a further metal layer as a radiation barrier. For example, this metal layer is deposited on the plastic body of the reflector array 17 as a copper of nickel layer, thus forming a protection against thermal stress resulting from irradiation of the LEDs 16. The metal layer is also able to deflect heat to the reflector edge in the area of the light-emitting surface 25. This metal layer may be thicker than the metalized reflecting surfaces on the reflector surfaces. The reflector edges (for example, the light-emitting surfaces 25 of the individual reflector elements 18) follow the course of a Petzval surface of the secondary optics 4 and are thus located on a convex curved disc (when the projection optics 4 is designed in the form of a reflector) or on a concave curved disc (when the projection optics 4 is designed in the form of a lens).

FIGS. 6A-6D show a further example of a substitute light source 2 in which the primary optics elements 18 are designed in the form of a light conductor. The light conductor array 17 includes light conductors which are arranged next to each other in a straight line and which are conically expanding toward the light exit 25. Perpendicular to the optical axis 23 or to the primary beam direction 29 of the light sources 16 (see FIG. 8A), the light conductors may include triangular, square, or rectangular cross-sections. In the example shown, the light conductor elements 18 have a rectangular or square cross-section. The light conductors 18 may have the geometric form of a truncated pyramid. Further, the individual light conductor elements 18 may have a plane light ingress surface extending parallel to a chip surface of the attached light source 16 (including at least one LED).

The individual light conductors 18 may have a convex curved light-emitting surface 25. The light conductor array 17 includes organic or inorganic glass or of silicone rubber (LSR). For example, organic glasses include PMMA, COC, COP, PC, PSU or PMMI. The light-emitting surfaces 25 of the conical light conductors 18 follow the course of a Petzval surface of the secondary optic system 4 and are thus located on a convex curved disc (when the projection optics 4 comprises a reflector) or on a concave curved disc (when the projection optics 4 comprises a lens).

In the example shown in FIGS. 7A-7D, the substitute light source array 2 includes a primary optics array 17 composed of several disc-shaped light conductors 18. Each of the individual light conductors 18 has a light ingress surface 24, a light-emitting surface 25, a reflector surface 26, as well as two transport surfaces 27, wherein the light ingress and light-emitting surfaces 24, 25 and the reflector surface 26 form two focal lines subject to the figure law: the optical paths between the object-side and image-side focal line 30*a*, 30*b* have the same optical path lengths:→sumi (si×ni) =constant (see FIG. 9). The image-side focal line 30*a* is located on the light-emitting surface 25 of the light conductor 18. The lateral transport surfaces 27 of the light conductor 18 continuously expand toward the light-emitting surface 25 (see FIG. 7C). The reflector surface 26 is a ruled surface. The light conductor 18 may have a plane light ingress surface 24 which extends parallel to the chip surface of the attached LED light source 16. However, it is also possible that the light ingress surface 24 is slightly inclined in relation to the chip surface of the LED 16, resulting in the fact that both surfaces form a conical air gap which may expand toward the rear edge of the light conductor 18. The rear edge represents the edge facing away from the light-emitting surface 25. The light-emitting surface 25 of the light conductor 18 has a slight curvature, especially a convex curvature. The light-emitting surface 25 of the disc light conductors 18 follow the Petzval surface 20*a* of the secondary optics system 4 and are thus located on a convex curved disc (when the projection optics 4 include a reflector) or on a concave curved disc (when the projection optics 4 include a lens). The array 17 with light conductor discs 18 includes organic or inorganic glass or of silicone rubber LSR. For example, organic glasses comprise PMMA, COC, COP, PC, PSU or PMMI.

Figure 8A:
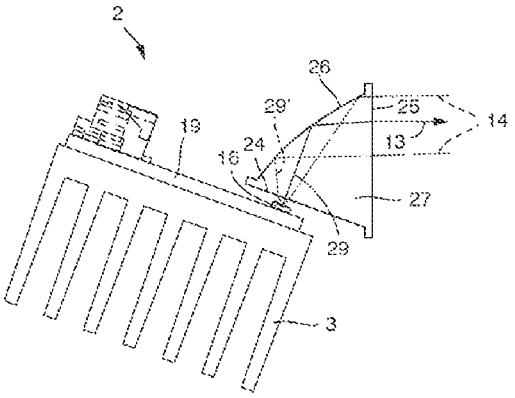
FIG. 8A shows a lateral view of a substitute light source of substitute light sources of the type shown in FIG. 7.
Figure 8B:
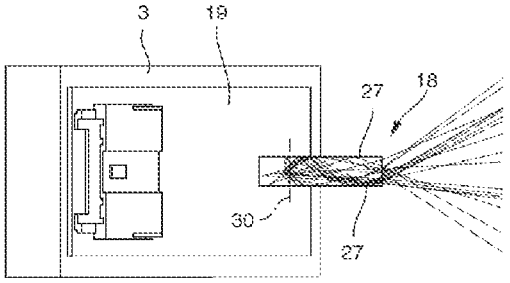
FIG. 8B shows a top view of a substitute light source of substitute light sources of the type shown in FIG. 7.

In FIGS. 8A-8B, the primary beam direction of a light source 16 is depicted with the reference numeral 29, representative for all light sources 16 of the light source array 15. The primary beam direction 29 coincides with the optical axis of the light source 16. The reference numeral 30 depicts a focal line of the light conductor 18.

Figure 9:
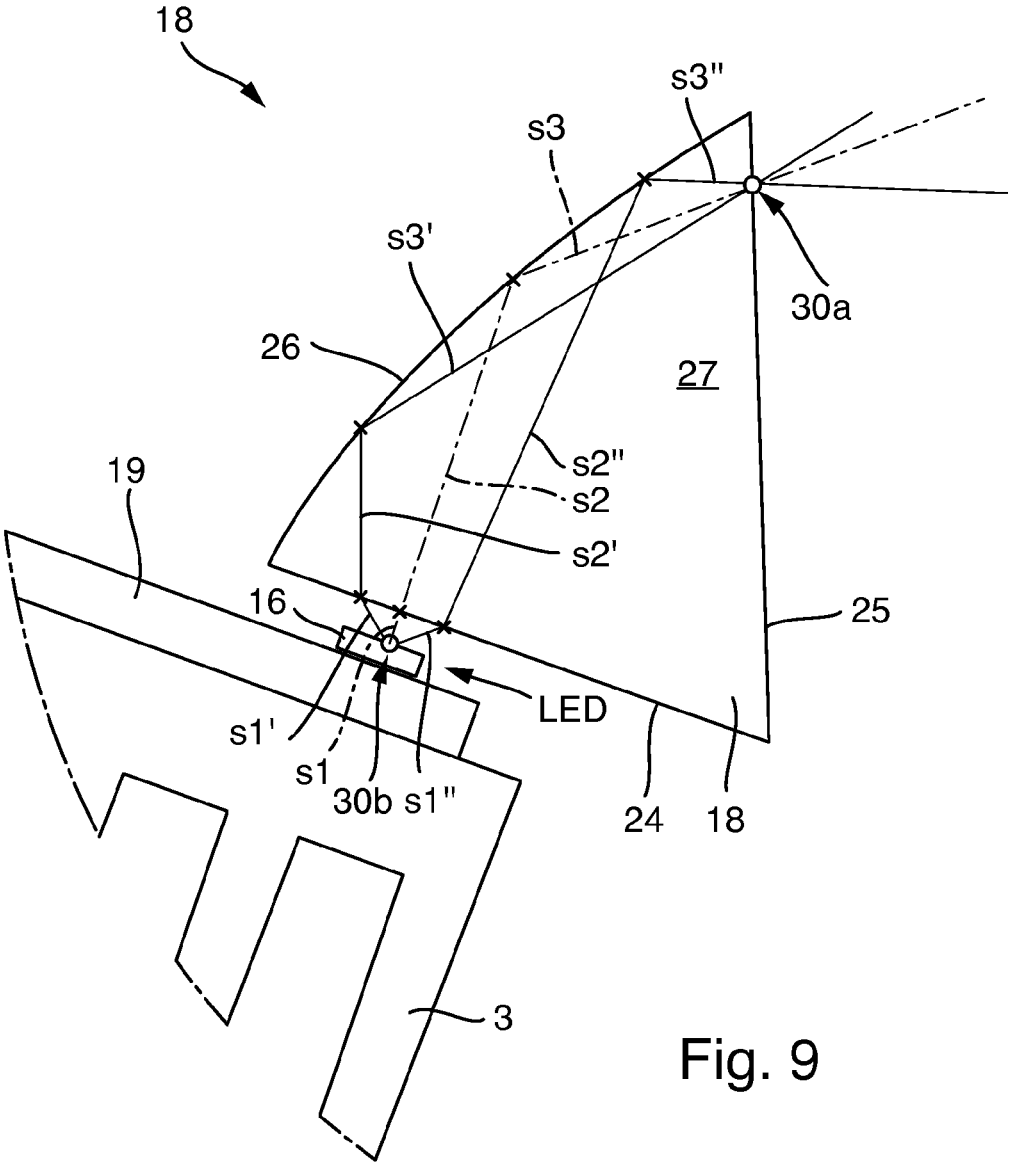
FIG. 9 shows a sectional view of FIG. 8A with a depiction of exemplary beam paths.

FIG. 9 shows that the disc-shaped light conductor 18 is designed in such a way that the optical paths between the two focal lines (the image-side focal line 30*a* and the object-side focal line 30*b*) of the light conductor 18 have the same optical path lengths: sumi (si×ni)=constant for all optical paths, wherein ni represent the refractive indices of the different media traversed (n1=1 of the air and n2, n3: refractive index of the light conductor 18). FIG. 9 shows examples of three optical paths: s, s' and s". The image-side focal line 30*a* is located on the light-emitting surface 25 of the light conductor 18, the object-side focal line 30*b* focuses on the light-emitting surface of the attached LED chip 16.

FIGS. 10-14 show sectional views of different embodiments of an invention-based light module 1. A portion of the optical surface of the secondary optics 4 has a first object-side focal point and a mutual image-side focal point in the infinite. As a result, the secondary optics 4 generates an image of the substitute light source array 2 or its light-emitting surfaces 25 in the infinite. For example, the secondary optics system 4 may include a parabolic minor, especially a facetted parabolic minor (see FIGS. 1-13), the focal point 31 of which is located on the light-emitting surface 25 of the primary optics array 17. The parabolic reflector 4 is facetted in such a way that all faceted surfaces have almost the same distances to the mutual focal point 31. All facet edges facing away from the optical axis (rotation axis) 7 of the light module 1 have larger distances to the mutual focal point of the reflector 31 than the internal facet edges located on the side of the optical axis 7. FIG. 1 shows that the facet edges extend in vertical direction to the light-dark boundary of the light distribution 5 (for example, the vertical light-dark boundary at the strip beam→horizontal facet edges). The facet edges can also have a circular shape and can extend in concentric manner about the optical axis 7 (rotation axis) of the reflector 4, 4'.

The secondary optics system 4 of the invention-based light module 1 may also include a collective lens which is focused on the light-emitting surfaces 25 of the primary optics elements 18. The collective lens can be designed in the form of a toric (astigmatic) collective lens which includes different sheet strengths in the meridian and sagittal section 8, 9. Furthermore, the collective lens can be designed also in the form of an astigmatic collective lens. Finally, the secondary optics system 4 may also include a color-correcting two-lens system (achromatic): a collective lens with minor color dispersion and a dispersing lens with major color dispersion.

Figure 10:
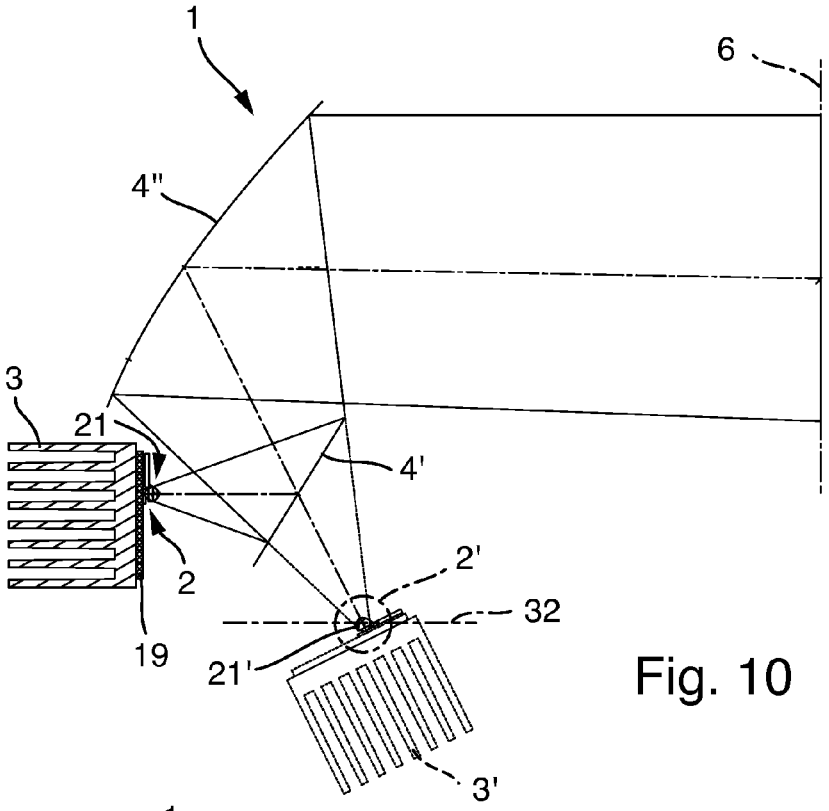
FIG. 10 shows a lateral view of an invention-based light module of one embodiment with a depiction of exemplary beam paths.

In the embodiment of an invention-based light module 1 shown in FIG. 10, the secondary optics system 4 includes a reflector in the form of a hyperboloid 4' or a plane minor as a special case of the hyperboloid with a reflector in the form of a paraboloid 4" located behind, especially a faceted paraboloid. An object-side focal point 21 of the hyperboloid 4' is located on the light-emitting surface 25 of the substitute light source array 2 and forms the object-side focal point of the entire secondary optics system 4. An image-side focal point 21' of the hyperboloid 4' coincides with the focal point of the paraboloid 4" and marks the position of a virtual intermediate image 2' of the light-emitting surface 25 of the substitute light source array 2.

As described above, FIG. 10 shows the light module 1 with a two-piece secondary optics system 4, including a plane minor 4' and a rotation paraboloid 4". The resulting secondary optics system 4 has an optical axis 32 (rotation axis). The paraboloid 4" focuses on the virtual image 2' of the light-emitting surface 25 of the substitute light source array 2, especially on the central area of the light-emitting surface 25 of the substitute light source array 2.

Figure 11:
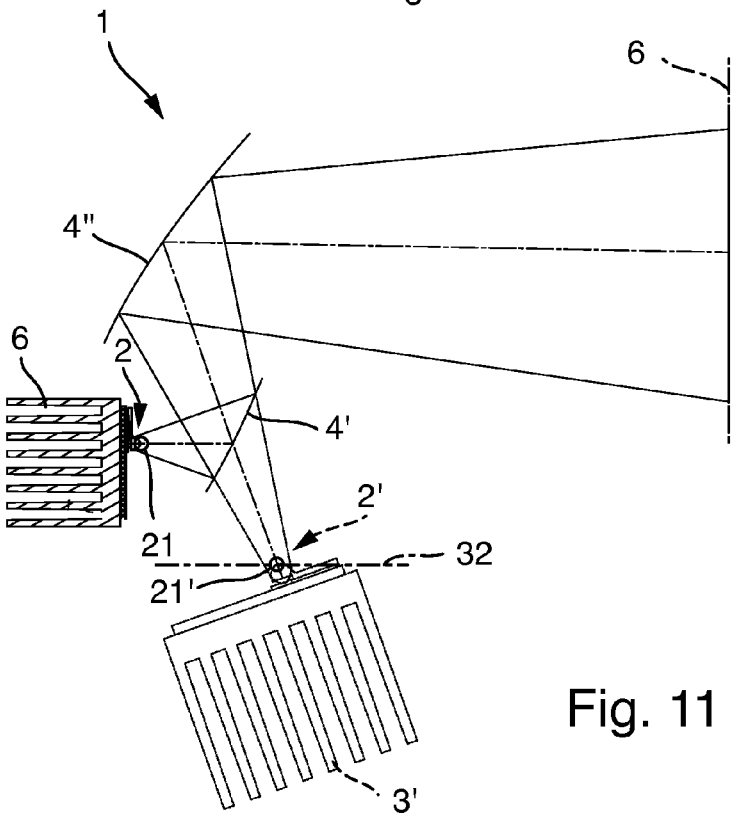
FIG. 11 shows a lateral view of an invention-based light module of one embodiment with a depiction of exemplary beam paths.

The embodiment shown in FIG. 11 also provides for a two-piece secondary optics system 4 with two reflectors 4', 4". The first reflector 4' of the secondary optics system 4 is designed in the form of a concave (collecting) hyperboloid.

As a result, the virtual image of the substitute light source 2 is larger than in the embodiment shown in FIG. 10. Furthermore, in FIG. 11, the object-side focal point 21 of the hyperboloid 4' is the object-side focal point of the entire secondary optics 4. The image-side focal point 21' of the hyperboloid 4' coincides with the focal point of the paraboloid 4" and marks the position of the virtual intermediate image 2' of the light-emitting surface 25 of the substitute light source array 2.

In the embodiment shown in FIG. 3, the secondary optics system 4 has also a multi-piece, especially two-piece design. The light module 1 comprises a convex (dispersing) hyperboloid 4''' and a paraboloid 4". The resulting secondary optics system 4 has the optical axis 32 (rotation axis). The image-side focal point 21' of the hyperbolic mirror 4''' coincides with the focal point of the paraboloid 4". The paraboloid 4" focuses on the reduced virtual image 2' of the light-emitting surface 25 of the substitute light source array 2.

Figure 12:
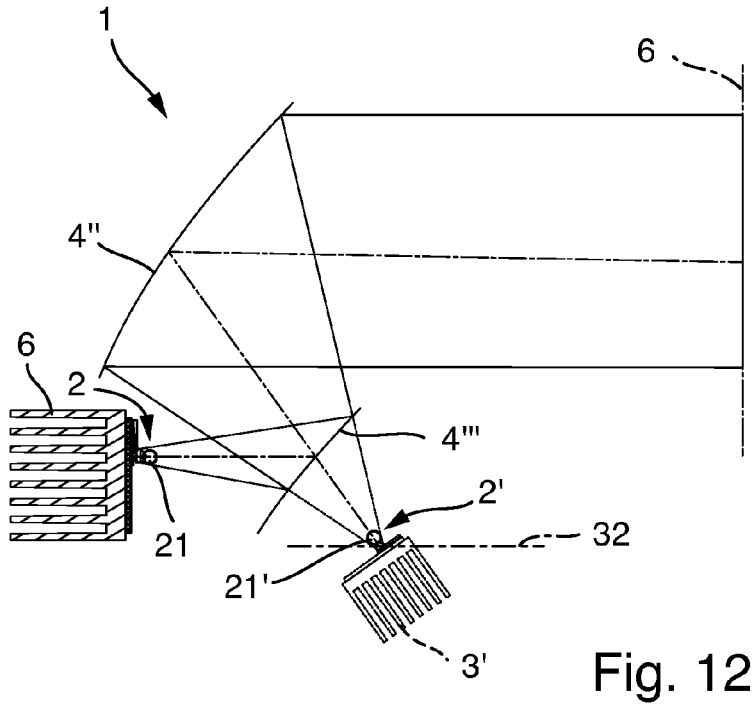
FIG. 12 shows a lateral view of an invention-based light module of one embodiment with a depiction of exemplary beam paths.

Referring to the embodiments shown in FIGS. 10-12, the secondary optics system 4 includes two reflectors that are not based on conical sections and that do not provide a sharp, undistorted intermediate image 2' of the light-emitting surface 25 of the substitute light source array 2. Rather, the secondary optics system 4 only forms the illuminated surface 25 on the road. The optical system 1 includes an object-side and an image-side focal point, wherein the image-side focal point is located in the infinite. The same optical path length is between the two focal points (sum s1=constant).

The hyperboloid reflector 4', 4''' can also have a faceted design. In the hyperboloid reflector 4', 4''', the image 21' of the object-side focal point 21 is not located in the infinite. Therefore, the arrangement of the reflector facets would differ from a spherical surface. The facets may be arranged in such a way that the respective distances to the object-side and image-side focal points (hyperbolic: virtual image) for all reflector facets are as equal as possible, making it possible to achieve for all reflector zones the most equal reproduction scales.

Figure 13:
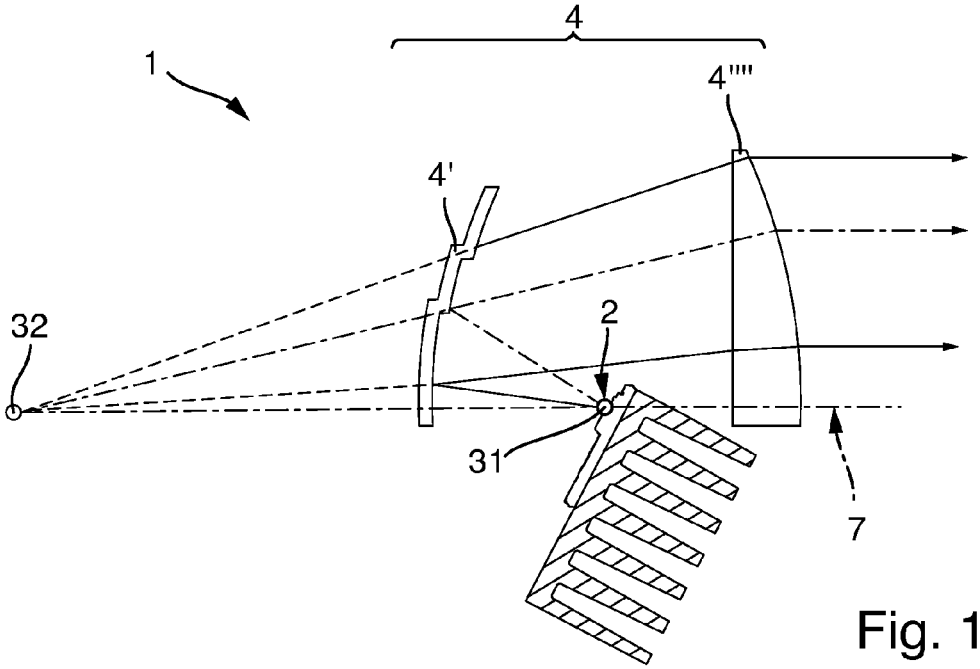
FIG. 13 shows a lateral view of an invention-based light module of one embodiment with a depiction of exemplary beam paths.

As shown in the embodiment of the invention-based light module 1 shown in FIG. 13, the secondary optics system 4 includes a hyperboloid reflector 4' and a collective lens 4'''' arranged in the collective corridor behind. The hyperboloid reflector 4' may be designed in the form of a horizontally faceted hyperboloid. An object-side focal point 32 of the collective lens 4'''' is coinciding with an image-side (virtual) focal point of the hyperbolic reflector 4'. An object-side focal point of the reflector 4' is depicted with the reference numeral 31 and is located on the light-emitting surface 25 of the substitute light source array 2 or on its central area.

Figure 14:
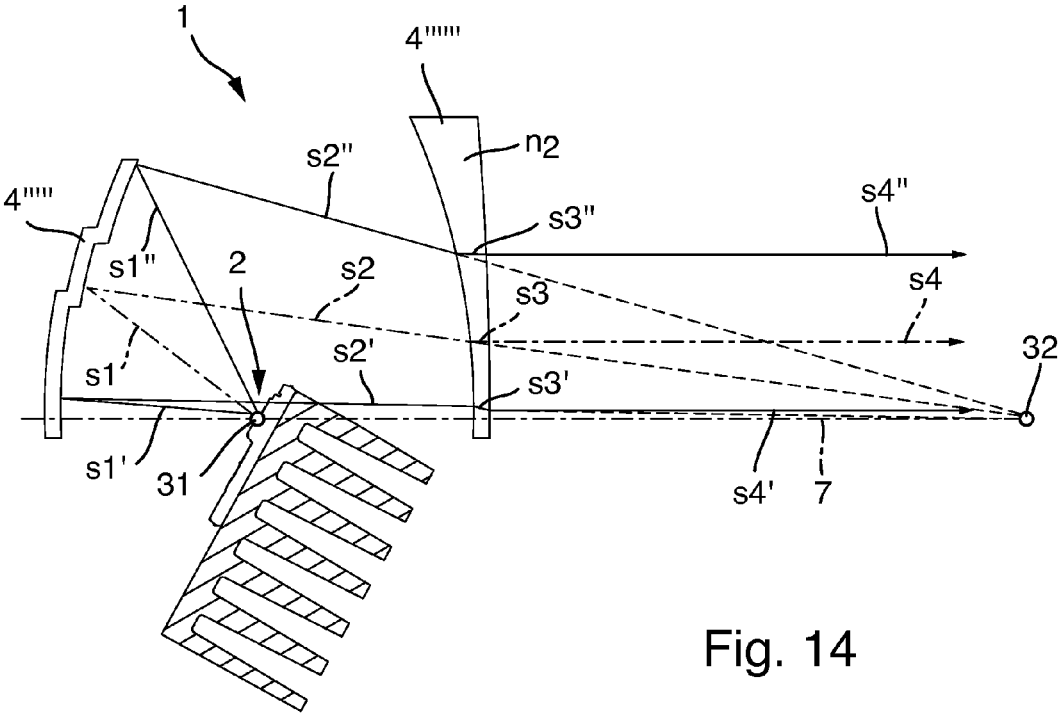
FIG. 14 shows a lateral view of an invention-based light module of one embodiment with a depiction of exemplary beam paths.

In the embodiment shown in FIG. 14, the secondary optics system 4 may include an ellipsoid reflector 4''''' and a dispersing lens 4''''' arranged behind. An image-side focal point 32 of the elliptic mirror 4''''' coincides with a virtual object-side focal point 31 of the dispersing lens 4'''''. An object-side focal point 31 of the ellipsoid reflector 4''''' is located on the light-emitting surface 25 of the substitute light source array 2 or on the central area. The dispersing lens 4''''' focuses on the enlarged image 2' of the substitute light source array 2.

The ellipsoid reflector 4''''' may be designed in the form of a faceted ellipsoid, especially with horizontal faceting. In the ellipsoid reflector 4''''' the image 32 of the object-side focal point 31 is not located in the infinite. The arrangement of the reflector facets differs therefore from a spherical surface. The facets may be arranged in such a way that the respective distances to the object-side and image-side focal points (ellipse: real image) for all reflector facets are as equal as possible, making it possible to achieve for all reflector zones the most equal reproduction scales. The secondary optics system 4 has a mutual optical axis 7 and includes multiple mirrors and/or lenses which provide no sharp, undistorted intermediate image 2' of the substitute light source array 2. However, in the sum, they have an object-side focal point 31 which is reproduced in an image-side focal point in the infinite. As a result, the optical system 1 is also subject to the figure law according to which all optical paths between the two focal points are equal in length: sumi (si×ni)=constant, wherein si the respective path of the optical path I and ni, respectively, represents the refractive indices of the different media traversed (n1=n2=n4=1 for air; n3≠1 corresponding to the material of the lens 4'''''). FIG. 14 shows in an exemplary manner three optical paths s, s' and s".

With the invention-based light module 1, it is intended to implement in the lighting equipment dynamic curve lighting, partial upper beam, marker lights and the like as resulting total light distribution 5 through well-directed activation and deactivation of individual light sources 16 or groups of light sources 16 without mechanically movable parts. However, alternatively or in addition to the well-directed activation or deactivation of light sources 16 for generating dynamic curve lighting, partial upper beam, marker lights as resulting total light distribution 5, or optionally for adjusting the light-dark boundary, it is also possible to swivel the light module 1, including of the light source array 15, the primary optics array 17, and the secondary optics system 4, in motor-controlled manner about a vertical and/or horizontal axis. As a result, it is possible, for example, to swivel dynamic curve lighting into the curve. Partial upper beam includes high beam distribution which selectively cuts out specific areas in which other road users are present. To be able to follow a motion of the other road users in relation to the motor vehicle equipped with the light module 1, it is possible to swivel in horizontal manner the light module 1 about the vertical axis so that the area omitted by the high beam distribution follows the actual position of the other road users. A marker light includes dimmed light distribution with a horizontal light-dark boundary, wherein selectively at least a very limited area above the light-dark boundary is illuminated in order to illuminate other road users or objects in this area and to draw the attention of the driver with the motor vehicle equipped with the light module 1 to these other road users or objects. To be able also in this case to follow a motion of the other road users or objects in relation to the motor vehicle so that the illuminated very limited area above the light-dark boundary is directed to the other road user or object, the light module 1 can be designed in such a way that it can be swiveled in horizontal manner about the vertical axis. For the purpose of adjusting a vertical light-dark boundary, the light module 1 can also be swiveled in horizontal manner about the vertical axis and be fixed in the adjusted position.

Also for adjusting a horizontal light-dark boundary, the light module can be swiveled in vertical manner about a horizontal axis and fixed in the adjusted position. The adjusted position of the light-dark boundary then forms the zero point for an adaptive headlight function and/or headlight range adjustment function to be performed during the process of operating the light module 1.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A light module for a lighting equipment of a motor vehicle comprising: a light source assembly with multiple separately controllable light sources combined to an array for emitting light; multiple primary optics elements combined to a primary optics array in the form of collective lenses each of which has a light ingress surface and a light-emitting surface, wherein the primary optics elements are designed to concentrate at least a portion of the light emitted by the light sources and to generate intermediate light distributions on the light emitting surfaces; and a secondary optics system for reproducing the emitted light on a road in front of the motor vehicle as resulting total light distribution of the light module, wherein the light sources are arranged between the light ingress surfaces of the collective lenses and object-side focal points of the collective lenses, and wherein the secondary optics system for reproducing the intermediate light distributions on the road in front of the motor vehicle as resulting total light distribution of the light module is focused at least on one of the light-emitting surfaces of the collective lenses, and wherein the secondary optics system includes a faceted parabolic reflector having internal edges located on the side of the optical axis and edges facing away from the optical axis wherein all facet edges facing away from the optical axis of said light module have larger distances to the mutual focal point of the reflector than the internal facet edges located on the side of the optical axis.

2. A light module as set forth in claim 1, wherein the light sources of the light source array are designed in the form of at least one of SMD LEDs and LED chips.

3. A light module as set forth in claim 1, wherein the primary optics elements are designed in the form of plano-convex lenses.

4. Lighting equipment of a motor vehicle, wherein the lighting equipment includes at least one light module as set forth in claim 1.

5. The lighting equipment as set forth in claim 4, wherein the lighting equipment includes a plurality of light modules, wherein the total light distributions of the light modules are one of at least partially superimposed and added to form a total light distribution of the lighting equipment.

* * * * *